United States Patent [19]

Schurmann

[11] 4,177,665

[45] Dec. 11, 1979

[54] COLD FLOW FORMING

[76] Inventor: Heinz P. Schurmann, 421 Abington Ave., Mississauga, Canada, L5A 1L6

[21] Appl. No.: 892,541

[22] Filed: Apr. 3, 1978

[51] Int. Cl.[2] ..... B21D 22/06

[52] U.S. Cl. ..... 72/359; 72/354; 72/475

[58] Field of Search ..... 72/354, 357, 359, 360, 72/377, 475

[56] References Cited

U.S. PATENT DOCUMENTS

| | | | |
|---|---|---|---|
| 376,508 | 1/1888 | Blancard | 72/475 X |
| 1,142,419 | 6/1915 | Hansen | 72/354 X |
| 3,962,899 | 6/1976 | Hubbell | 72/354 X |
| 4,078,415 | 3/1978 | Foch | 72/354 X |

*Primary Examiner*—Leon Gilden

*Attorney, Agent, or Firm*—Rogers, Bereskin & Parr

[57] ABSTRACT

A process and associated apparatus are provided for producing cold flow formed items from slugs. First and second dies are aligned for relative movement axially towards and away from one another. The dies have respective opposed first and second faces and the first face defines a cavity having portions including generally axial walls. The first die has a peripheral chamfer extending axially away from the first face and a sleeve is provided containing the dies to combine with outer parts of the second face and the peripheral chamfer to define an annular space. The slug is formed into the item by causing relative movement between the dies to impact the slug and then causing further relative movement so that the slug is caused to flow into contact with the axial walls and also into the annular space so that destructive forces applied to the axial walls are countered by forces applied to the chamfer thereby stabilizing the material of the first die between the axial walls and the chamfer. A slug for use with the die set is also provided.

14 Claims, 4 Drawing Figures

| MATERIAL DESIGNATION | P4 | 1524 | ROLAND | W2 | 1541 | M2 | S7 | 316L stainless | 403 stainless |
|---|---|---|---|---|---|---|---|---|---|
| C | 0.05 | 0.19-0.24 | 0.30 | 0.90 | 0.36-0.44 | 0.84 | 0.50 | 0.03max | 0.15max |
| Si | 0.08 | 0.15-0.30 | 0.80 | 0.20 | - | 0.30 | 0.25 | - | - |
| Mn | 0.14 | 1.35-1.65 | 0.40 | 0.27 | 1.35-1.65 | 0.25 | 0.70 | - | - |
| Cr | 3.90 | - | 3.00 | - | - | 4.00 | 3.25 | 16.0-18.0 | 11.5-13.0 |
| Mo | 0.50 | - | 2.80 | - | - | 5.00 | 1.40 | 2.0-3.0 | - |
| Co | - | - | 2.80 | - | - | - | - | - | - |
| V | 0.10 | - | 0.50 | 0.07 | - | 1.90 | - | - | - |
| P | - | 0.035max | - | - | traces | - | - | - | - |
| S | - | 0.45max | - | - | traces | 0.02 | - | - | - |
| W | - | - | - | - | - | 6.5 | - | - | - |
| N | - | - | - | - | - | - | - | 10.0-14.0 | - |
| SLUG ROOF INC. ANGLE | 100 | 120 | 120 | 120 | 120 | 120 | 120 | 120 | 120 |
| SLUG HARDNESS ROCKWELL "C" | 16 | 20 | 20 | 18 | 18 | 22 | 22 | 16 | 16 |
| PRESS LOAD (TONS) | 190 | 185 | 171 | 168 | 176 | 190 | 182 | 198 | 200 |
| INITIAL IMPACT SPEED mm/sec | 4 | 4 | 4 | 4 | 6 | 8 | 6 | 8 | 8 |
| MATERIAL COLD FLOW SPEED mm/sec | 2 | 3 | 4 | 4.5 | 5 | 4 | 4 | 4 | 4 |
| RESULTS | Fair | Good | Excel-lent | Good | Good | Good | Good | Good | Good |

FIG. 4

COLD FLOW FORMING

This invention relates to apparatus and process for use in cold flow forming metals and more particularly for use where sideways flow is needed in forming a product from a slug.

Many products are now made by various types of cold flow forming. The type of forming used will depend upon the shape of the product required. However in general the process consists of causing an initial metal flow by impacting a slug and then maintaining the flow using a predetermined rate of relative movement between the dies.

The present invention is directed to a type of cold flow forming in which an axial force is applied to a slug to cause the slug to flow transversely inside a cavity formed between two die halfs. Often the item to be formed is such that when the slug begins to flow the walls of the cavity in the die are subject to forces somewhat analogous to hydraulic forces and consequently there is a tendency for the die to be subjected to large outward forces tending to explode the die. The problem has been overcome to some extent by using very heavy dies which can withstand these large outward forces.

A further limitation of cold flow processes is the maximum load which can be applied by the die. Quite often the load must be limited to avoid die breakage so that items must then be formed in a series of stages interrupted by heat treatments. Any attempt to make such items in one step results in repeated die breakages.

For the above reasons the objects of the present invention include providing a process and an apparatus for producing items by cold flow forming using reduced die loading and lighter and less massive dies.

Accordingly in one of its aspects the invention provides a process for producing cold flow formed items from slugs. A slug to be cold flow formed is provided together with first and second dies which are aligned for relative movement axially towards and away from one another. The dies have respective opposed first and second faces and the first face defines a cavity having portions including generally axial walls. This die also has a peripheral chamfer extending axially away from the first face and a sleeve is provided containing the first and second dies to combine with the second face and the peripheral chamfer to define an annular space. The slug is placed between these dies inside the sleeve and relative movement is caused between the dies at a predetermined velocity so that there is an impact between the dies and the slug. The relative movement continues at a second predetermined velocity which is less than the initial predetermined velocity so that the slug is caused to cold flow into contact with the generally axial walls and also into the annular force. Consequently destructive forces applied to the axial walls are countered by forces applied to the chamfer thereby stabilizing the material of the first die between the axial walls and the chamfer.

In another of its aspects the invention provides a die set for use in cold flow forming items from slugs. The die set includes first and second dies having respective opposed first and second faces and the first face defines a cavity having portions including generally axial walls. The first die has a peripheral chamfer extending axially away from the first face and a sleeve is provided to contain the dies with the dies aligned for relative movement axially towards and away from one another. The sleeve combines with the second face and the peripheral chamber to define an annular space so that upon causing cold flow forming to take place between the dies, the slug will flow into contact with the generally axial walls and also into the annular space. Consequently destructive portions applied to the axial walls are countered by forces applied to the chamber thereby stabilizing the material of the first die between the axial walls and the chamfer.

In yet another of its aspects the invention provides a slug for use in cold flow forming operations to form the slug into a pressing which is subsequently further worked to create a finished part.

These and other aspects of the invention will be better understood with reference to the drawings, in which:

FIG. 4 is a table of results for tests of different materials in making the exemplary blank.

Figure 1:
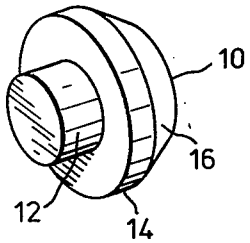
FIG. 1 is a perspective view of an exemplary gear blank to be cold flow formed from a slug.

Reference is first made to FIG. 1 which illustrates an exemplary blank. This blank is to be used for making a bevel gear that has been cold flow formed and the process of the making the blank together with a die set used in its manufacture will be described with reference to FIGS. 2 and 3. It will be understood that the blank is chosen to demonstrate preferred embodiments of the process and apparatus and that the blank is typical of many different items which can be cold flow formed in accordance with the invention.

As seen in FIG. 1 a blank 10 consists of a short cylindrical portion 12 disposed about a common axis with a larger cylindrical portion 14. This latter portion blends into a frusto-conical portion 16 which in this case will eventually be machined to provide bevel gear teeth.

If preferred the teeth could also be cold flow formed in the same operation. It will be appreciated that the portions of the blank 10 meet one another at radiused parts to avoid sudden changes in cross-section. These radiused parts may not be apparent from the drawings but are inherent in cold flow forming to limit stress concentrations and to lengthen die life.

Figure 2:
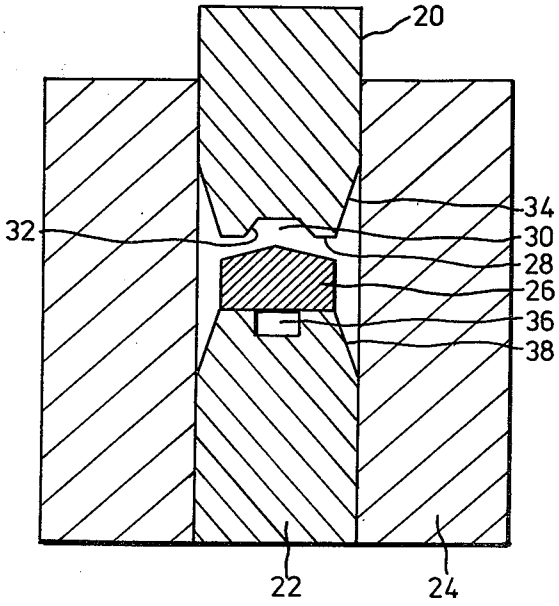
FIG. 2 is a somewhat diagrammatic sectional view of a die set having a cavity for forming the blank from the slug.

Reference is next made to FIG. 2 which illustrates a die set 18 consisting of a movable first die 20 aligned with a fixed second die 22 and contained within a robust sleeve or collar 24. The die set is shown in a preliminary position in which a slug 26 is centered with respect to the die 22 and resting on the die. The first die by contrast is spaced from the slug 26 prior to driving this die into contact with the slug.

In the arrangement shown in FIG. 2, the die 20 defines a first face 28 which defines a cavity 30 having generally axial walls 32. The first face 28 terminates at its perimeter in a chamfer 34 which extends axially away from the first face 28. Similarly, the die 22 includes a second face on which the slug rests and which defines a cavity 36. This second face terminates at a second chamfer 38.

The chamfers 34, 38 preferably include an angle of 15° with respect to an inside wall of the sleeve 24. It has been found that this angle permits flow of material quite readily without significant failure both of the die and of the blank.

The slug 26 is proportioned to rest with a lower one of its impact surfaces on the second face of the die 22 and it should be noted that the slug covers this face. This contrasts sharply with prior art cold flow forming processes in which the slug in this arrangement would be designed to fit within cavities 32, 36 and flow would take place first in these cavities and then outwards towards the periphery between the dies. In the present process the slug is formed to enhance flow outside the die faces and into a peripheral space created by the inner surface of the sleeve 24 and the chamfers 34, 38. The reasons for this flow will be described later.

It should also be noted that the slug 26 is crowned on its upper impact surface. In this embodiment the crown would be conical and the included angle at the apex of the crown would be about 110°. As a result of this crowning when the die 20 is driven into engagement with the slug it will be appreciated that line contact is made rather than surface to surface contact. Consequently there will be a very high stress concentration where contact is made and this precipitates cold flowing which continues as the die 20 is driven further towards the die 22. The arrangement permits quite low forces to be used compared with those necessary in prior art structures and also the sizes of the dies are reduced for reasons which will become evident with reference to FIG. 3.

Figure 3:
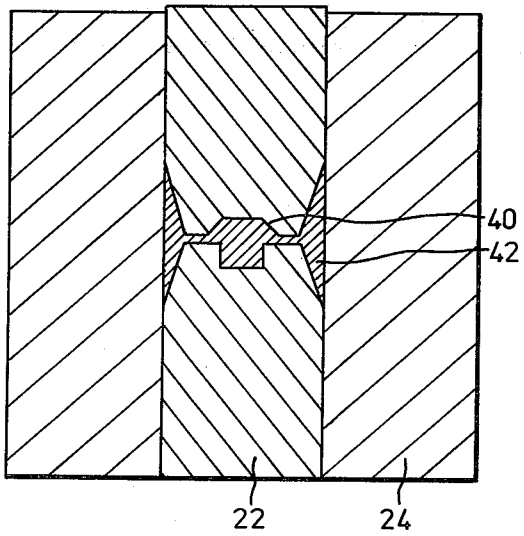
FIG. 3 illustrates the die set after the slug has been cold flow formed into the shape of the blank.

As the die 20 moves further towards the second die 22, cold flowing will take place and eventually the slug will be formed into the intermediate pressing shown in FIG. 3. This pressing is essentially in two parts. A first part 40 corresponds to the required gear blank 10 (FIG. 1) and a second peripheral part 42 formed in the space defined by the chamfers 34, 38 (FIG. 2). As the forming takes place the metal is forced both into the cavities in the dies and into the peripheral space. Because the metal exhibits properties which to a large extent can be analysed by analogy to hyrostatic situations, there will be outward forces applied on the generally axial walls of the cavities which would tend to explode the dies. Formerly these forces were absorbed by using very heavy dies whereas in the present arrangement the flow in the annular space will create inward forces which effectively counteract the outward forces and thereby limit the tendency for the forces created in the cavities to explode the dies. It will be evident that there will also be a significant outward force on the sleeve 24 but this can be absorbed by providing one or more sleeves of sufficient strength. In fact, the sleeve can be reinforced quite readily because its shape is quite simple.

After withdrawing the first die 20 the intermediate pressing shown in FIG. 3 is removed from the sleeve 24 and the second part 42 is machined off the first part leaving the gear blank shown in FIG. 1. It will be appreciated that any tendency for the pressing to crack or for other imperfections to appear will be greatest adjacent the edges and this is in the part which is being removed. Consequently the finished gear blank tends to be of very good quality.

FIG. 4 illustrates test results obtained by using the process of the invention in producing blanks similar to that shown in FIG. 1. It will be seen that good results were obtained using quite low press forces and using materials which are not always readily cold flow formed.

The material of the tool used for the materials P4 and 1524 was S5 having a hardness 57 Rockwell "C" and for the other materials M2 having a hardness 61 Rockwell "C".

The exemplary use of a gear blank should not be interpreted to limit the scope of the inventive process and apparatus. As previously mentioned the process and corresponding die sets can be used wherever cold flow forming takes place primarily outwards between the dies.

In general the exact form of the slug to be used will depend upon such factors as the material of the slug and the shape to be cold flow formed. However the impact surface of the slug would normally have a projected area in plan at least approximating the planar area of the face of the die surrounded by the chamfer. For instance in FIG. 1 the face 28 surrounded by chamfer 34. (By way of explanation, the projected area of the slug will be measured in a plane lying at right angles to the direction of motion of the impact die with the slug in position for cold flow forming).

Also, the slug 26 shown in FIG. 1 could be crowned on its lower surface where it engages the surface of the second die 22. The included angle of the conical crowning will vary and some testing will be necessary to obtain the best angle. However it has been found that most cold flow forming can be done using crowning angles in the order of 110 to 120 degrees although angles from 180 to 84 degrees have been used. Generally the larger the angle the greater the distribution of the initial impact load; and the smaller the angle the greater the risk of die breakage. This is because smaller angles cause a wedging action at the boundary of the cavity so that the sudden impact loading on the die which will have a large outward component tending to explode or break the die.

It can therefore be stated that the slug would be crowned on one of its impact surfaces, and that in plan the impact surface would have a projected area at least approximating the planar area of the face of the die which is to impact that impact surface and also a shape similar to that of this face. The crowning of course need not be truly conical. The driven or first die would mostly have a predetermined impact speed greater than the speed used to drive this die after impact. However it has been found that some cold flow operations require the same impact and flow speeds so that it can be stated that this die is driven with a flow speed after impact which is no greater than the impact speed.

It has been found that the dies used for cold flow forming by the present method are lighter than conventional dies and that they are subject to less damaging stresses. It should be noted however that to achieve the desired flow the slug should be shaped so that it commences to flow about the chamfer around the die contemporaneously with flow in the cavity so that the explosive loads on the tool are balanced by the loads on the chamfer.

I claim:

1. A process for producing cold flow formed items from slugs, the process comprising the steps:

providing a slug to be cold flow formed;

providing first and second dies aligned for relative movement axially towards and away from one another, the dies having respective opposed first and second faces and the first face defining a cavity having portions including generally axial walls, and the first die having a peripheral chamfer extending axially away from the first face;

providing a sleeve containing the first and second dies to combine with outer parts of the second face and the peripheral chamfer to define an annular space;

placing the slug between said dies inside the sleeve;

causing said relative movement between the dies to create an impact between the slug and the dies;

causing said relative movement to continue so that the slug is caused to cold flow into contact with said generally axial walls and also into the annular space so that destructive forces applied to the axial walls are countered by forces applied to the chamfer thereby stabilizing the material of the first die between the axial walls and the chamfer.

2. A process as claimed in claim 1 in which the second die defines second axial walls and a second peripheral chamfer so that the annular space is then defined by the first and second peripheral chamfers and the sleeve.

3. A process as claimed in claim 1 wherein the slug is provided having a crowned impact surface for impact engagement with said first face.

4. A process as claimed in claim 2 in which the slug is provided having respective first and second crowned impact surfaces for respective impact engagement with said first and second faces.

5. A process as claimed in claim 3 in which the slug is provided with the impact surface having a projected plan area at least approximating the planar surface area of the first face surrounded by the peripheral chamfer, and the projected plan area having a similar shape to the first face.

6. A process as claimed in claim 4 in which the slug is provided with each of the impact surfaces having a projected plan area at least approximating the planar surface area of the respective first and second faces of the dies surrounded by the associated peripheral chamfers, each of the projected plan areas having similar shapes to the respective first and second faces.

7. A process as claimed in claim 3 in which the slug is provided with the crowned impact surface defining an included angle greater than 84 degrees.

8. A process as claimed in claim 4 in which the slug is provided with each of the crowned impact surfaces having an included angle greater than 84 degrees.

9. A process as claimed in claim 1 in which the first die is provided with the peripheral chamfer defining an angle of about 15 degrees with the sleeve.

10. A process as claimed in claim 2 in which the first and second dies are provided with respective peripheral chamfers having angles of about 15 degrees with the sleeve.

11. A die set for use in cold flow forming an item from a slug, the die set comprising:

first and second dies having respective opposed first and second faces, the first face defining a cavity having portions including generally axial walls, and the first die having a peripheral chamfer extending axially away from the first face; and a sleeve adapted to contain the dies with the dies aligned for relative movement axially towards and away from one another, the sleeve combining with outer parts of the second face and the peripheral chamfer to define an annular space so that upon causing cold flow forming to take place between the dies the slug will flow into contact with the generally axial walls and also into the annular space so that destructive forces applied to the axial walls are countered by forces applied to the chamfer thereby stabilizing the material of the first die between the axial walls and the chamfer.

12. A die set as claimed in claim 11 in which the second die defines second axial walls and a second peripheral chamfer so that the annular space is then defined by the first and second peripheral chamfers and the sleeve.

13. A die set as claimed in claim 11 in which the peripheral chamfer defines an angle of about 15 degrees with the sleeve after assembly.

14. A die set as claimed in claim 12 in which the peripheral chamfers each define angles of about 15 degrees with the sleeve after assembly.

* * * * *